US005718011A

United States Patent [19]

Nogues

[11] Patent Number: 5,718,011

[45] Date of Patent: Feb. 17, 1998

[54] DEVICE FOR CLEANING BABIES

[76] Inventor: Nelson E. Nogues, 3115 NW. 96 St., Miami, Fla. 33147

[21] Appl. No.: 842,173

[22] Filed: Apr. 23, 1997

[51] Int. Cl.[6] ..... A47D 15/00

[52] U.S. Cl. ..... 5/655; 5/603; 5/650

[58] Field of Search ..... 5/655, 630, 632, 5/648, 650, 603, 604, 602, 618, 620, 624; 128/869

[56] References Cited

U.S. PATENT DOCUMENTS

| | | | |
|---|---|---|---|
| 2,700,381 | 1/1955 | Powell | 5/603 |
| 2,995,407 | 8/1961 | Izzi | 5/603 |
| 3,532,336 | 10/1970 | Baker | 5/650 |
| 3,721,434 | 3/1973 | Spies | 5/655 |
| 3,967,128 | 6/1976 | Smulewicz | 5/603 |
| 4,027,869 | 6/1977 | Ruiz | 5/603 |
| 4,180,062 | 12/1979 | Alberti et al. | 5/602 |
| 4,205,669 | 6/1980 | Hamann | 5/603 |
| 4,938,468 | 7/1990 | Akiko | 5/602 |

*Primary Examiner*—Alexander Grosz
*Attorney, Agent, or Firm*—J. Sanchelima

[57] ABSTRACT

A device for cleaning a baby by supporting him/her by a flat cushioned surface at a parallel relationship with respect to a supporting ground. A rectangular frame supports the cushioned surface. Two elongated members are hingedly mounted to one end of the frame that includes a bay inbetween the elongated members. Straps are slidably and adjustably mounted over the length of the frame and elongated members. The angular position of the elongated members with respect to the flat cushioned surface is adjustable to one of several predetermined positions.

6 Claims, 2 Drawing Sheets

DEVICE FOR CLEANING BABIES

BACKGROUND OF THE INVENTION

1. Field of the Invention

The present invention relates to a device for cleaning infants/babies, and more particularly, to the type that includes a back supporting padded assembly that is hingedly mounted to a leg holding assembly.

2. Description of the Related Art

Applicant believes that the closest reference corresponds to U.S. Pat. No. 3,721,434 issued to L. S. Spies in 1973. However, it differs from the present invention because it does not provide a bay to which elongated members are hingedly mounted so that a baby's genitals and anal area can be exposed for dressing and cleaning. These features permit an adult user to expeditiously clean a baby or infant and helps him or her keep control.

Other patents describing the closest subject matter provide for a number of more or less complicated features that fail to solve the problem in an efficient and economical way. None of these patents suggest the novel features of the present invention.

SUMMARY OF THE INVENTION

It is one of the main objects of the present invention to provide a device that permits a user to readily clean a baby's genitals and anal area in a clean environment.

It is another object of this invention to provide a device that has such a comfortable padded resting surface that facilitates cleaning a baby.

It is another object of the present invention to provide a device that includes a leg holding assembly that holds both baby's legs separated thereby temporarily restraining any excessive or sudden movement.

It is yet another object of this invention to provide such a device that is inexpensive to manufacture and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE PREFERRED EMBODIMENT

Figure 1:
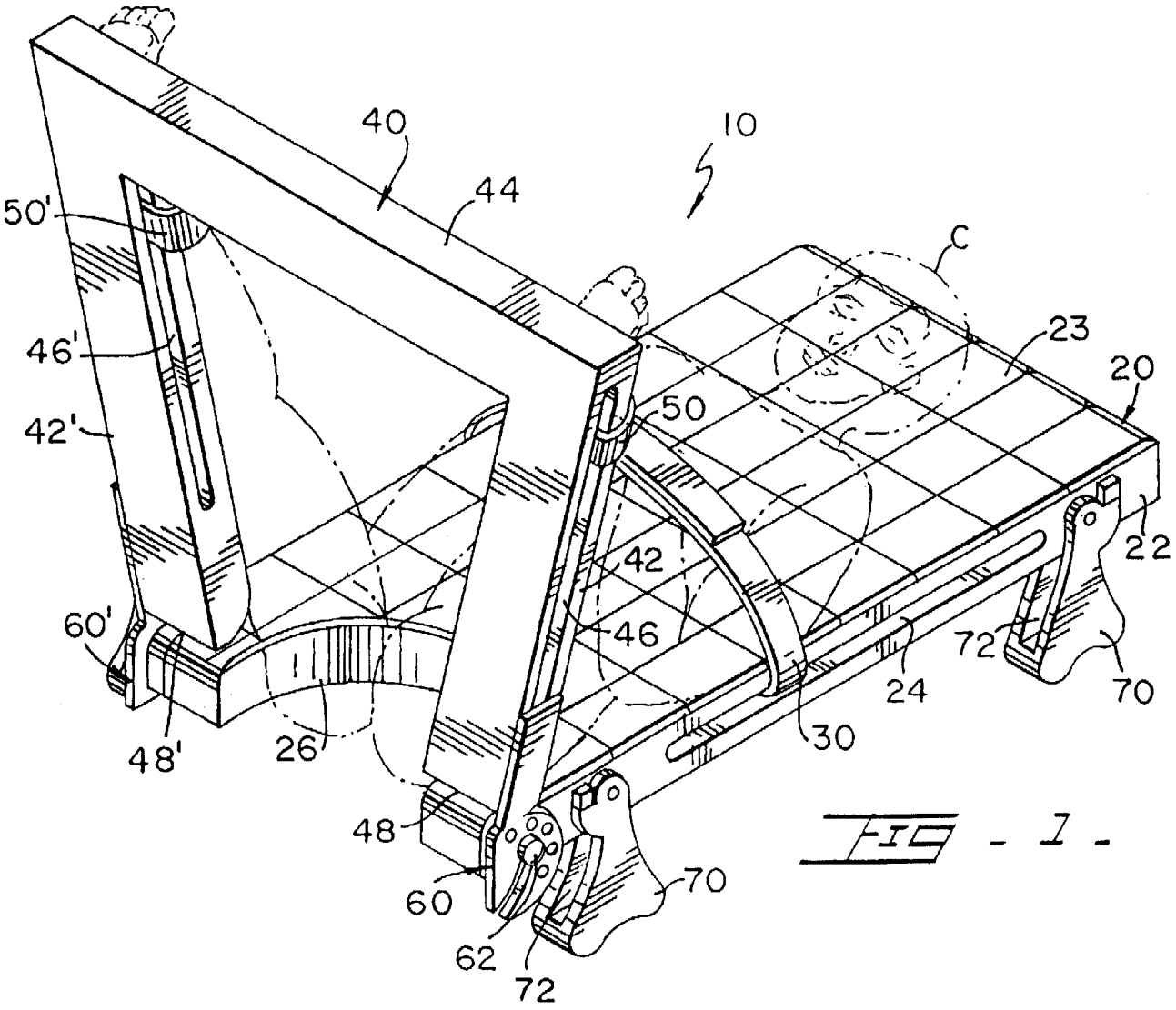
FIG. 1 is an isometric view from the top of the preferred embodiment of the present invention showing a user in phantom.

Referring now to the drawings, where the present invention is generally referred to with numeral 10, it can be observed that it basically includes horizontal resting assembly 20 with strap member 30 mounted thereon to secure child C in place. Holding assembly 40 is hingedly mounted to one end of resting assembly 20 with straps 50 and 50' mounted, substantially at the other end of assembly 40. Leg members 70 support device 10 over a horizontal supporting surface at a spaced apart relationship.

Resting assembly 20, in the preferred embodiment, includes a substantially rectangular frame member 22 with padded surface 23 mounted therein, thereby providing an effective flat surface that supports a user. Resting assembly 20 also includes two slots 24 (only one shown) located at both lateral sides of frame member 22 and are designed to receive strap member 30. Strap member 30 may include at its two ends fastening members, such as mating Velcro pads or other equivalent fastening members. Strap member 30 is passed through slots 24 to tie a baby (user) down to padded surface 23 and can be adjusted depending on the needs and/or dimensions of the baby. Resting assembly 20 has bay 26 that extends inwardly and is located at the end of assembly 20, where one end of assembly 40 is hingedly mounted.

Figure 2:
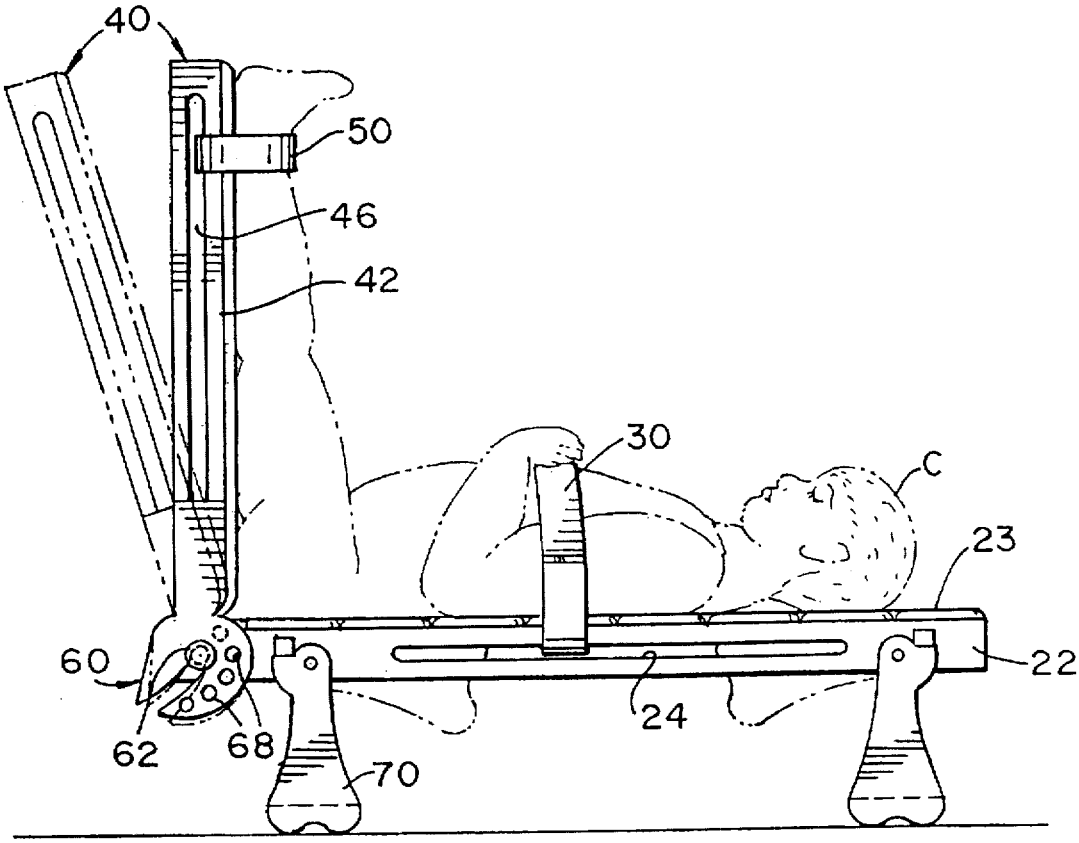
FIG. 2 is an elevational side view of this invention, showing the movement of leg members and leg holding assembly.
Figure 2A:
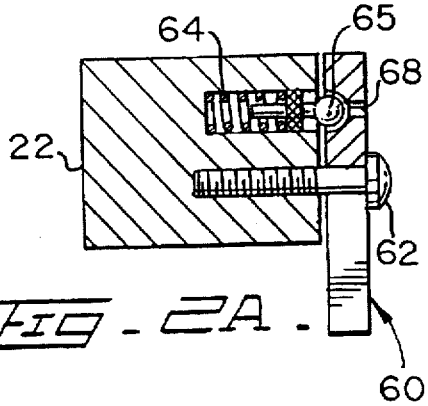
FIG. 2A is a detailed partial cross-section of the positioning bracket assembly.

Holding assembly 40 is hingedly mounted to one end of resting assembly 20 by axles 62 and 62' (not shown) of positioning bracket assemblies 60 and 60' that in turn are rigidly mounted to ends 48 and 48'. Assembly 40, in the preferred embodiment, includes elongated members 42 and 42' spaced apart by spacer member 44. Members 42 and 42' extend outwardly with respect to each other from ends 48 and 48' that are hingedly mounted to one end of rest assembly 20. Elongated members 42 and 42' have a rectangular cross-section and include slots 46 and 46' to cooperatively receive straps 50 and 50', respectively. Mating Velcro pads are included at the ends of straps 50 and 50', but other equivalent fastening devices can also be used. In this manner, the baby's legs are fastened to holding assembly 40 with straps 50 and 50' and her/his legs are held apart to facilitate a user to clean his/her genitals and anal area. Elongated members 42 and 42' have sufficient length to substantially co-extend with the baby's legs. Once the baby is placed on padded surface 23 of resting assembly 20 and fastened with straps 30; 50 and 50', a user moves assembly 40 towards the baby's torso, and his/her genital area is exposed to be readily cleaned. The angular position of elongated members 42 and 42' with respect to padded or cushioned surface 23 is adjustable to one of several predetermined positions, as best seen in FIG. 2.

Positioning bracket assembly 60 is designed to adjust the position of elongated members 42 and 42' with respect to frame 22 of resting assembly 20 by permitting the pivoting of the elongated members about a horizontal pivot axis. Positioning bracket assembly 60 includes a plurality of openings 68. Positioning bracket assembly 60 also have spring loaded pin 65 biased to partially penetrate one of openings 68 helped by spring member 64. Spring loaded pin 65 and openings 68 have cooperative shapes so that upon the exertion of a predetermined force, pin 65 can be cammingly dislodged from predetermined opening 68.

Device 10 is supported on retractable four leg members 70 that in turn rests on a horizontal supporting surface. Leg members 70 are pivotally mounted to frame member 22. Leg members 70 include slot 72 to cooperatively receive the lower edge of frame 22 that permits a user to fold them and occupy less area for storage.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A device for cleaning a baby, comprising:

A) a substantially rectangular frame including a flat cushioned surface having first and second ends, said first end including a bay;

B) first and second elongated leg supporting members each having third and fourth ends and said third ends being hingedly mounted to said first end in a spaced apart relationship with respect to each other on opposite sides of said bay;

C) first strap means, for restraining the movement of a baby, mounted to said frame;

D) second strap means for restraining the movement of the legs of the baby mounted on said first and second elongated members; and E) means for adjusting the position of said first and second elongated members with respect to the frame, about a horizontal pivot axis.

2. The device set forth in claim 1 wherein said frame member includes longitudinally extending slots that cooperatively receive said first strap member thereby permitting the adjustment of their longitudinal location of said first strap means.

3. The device set forth in claim 2 wherein said frame member includes four retractable leg members so that said frame is suspended above a supporting plane.

4. The device set forth in claim 3 wherein said first and second elongated members extend outwardly with respect to each other from said first end so that the baby's legs are separated to facilitate his/her cleaning.

5. The device set forth in claim 4 wherein said first and second elongated members include a spacer member that rigidly connects the fourth ends of said first and second elongated members.

6. The device set forth in claim 5 wherein said means for adjusting the position of said first and second elongated members with respect to said frame includes at least one bracket assembly rigidly mounted to said frame and including a plurality of openings and further including a spring loaded pin biased to partially penetrate said opening and said pin and opening having cooperative shapes so that upon the exertion of a predetermined force said pin can be cammingly dislodged from said opening.

* * * * *